US006719073B2

(12) United States Patent
Xiang et al.

(10) Patent No.: US 6,719,073 B2
(45) Date of Patent: Apr. 13, 2004

(54) SINGLE-CONE ROCK BIT HAVING CUTTING STRUCTURE ADAPTED TO IMPROVE HOLE CLEANING, AND TO REDUCE TRACKING AND BIT BALLING

(75) Inventors: Ying Xiang, The Woodlands, TX (US); George B. Witman, IV, Sugarland, TX (US); Michael A. Siracki, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/152,498

(22) Filed: May 21, 2002

(65) Prior Publication Data

US 2003/0217867 A1 Nov. 27, 2003

(51) Int. Cl.[7] ..... E21B 10/14
(52) U.S. Cl. ..... 175/336; 175/365
(58) Field of Search ..... 175/334, 336, 175/355, 365, 406, 408, 343, 337, 339, 340

(56) References Cited

U.S. PATENT DOCUMENTS 2,025,261 A * 12/1935 Zublin ..... 175/337
6,119,797 A * 9/2000 Hong et al. ..... 175/336
6,167,975 B1 * 1/2001 Estes ..... 175/331
6,439,326 B1 * 8/2002 Huang et al. ..... 175/334

FOREIGN PATENT DOCUMENTS

DE 209227 A 4/1984

OTHER PUBLICATIONS

Great Britain Combined Search and Examination Report dated Sep. 22, 2003 (2 pages).

* cited by examiner

*Primary Examiner*—Frank Tsay
(74) *Attorney, Agent, or Firm*—Rosenthal & Osha L.L.P.

(57) ABSTRACT

A roller cone drill bit is disclosed which includes a bit body adapted to be coupled to a drill string, a bearing journal depending from the bit body and a single roller cone rotatably attached to the journal. The roller cone has a plurality of inserts disposed thereon. In one aspect, the inserts have an extension length of at least 0.6 inches. A roller cone drill bit is disclosed, including a bit body, a bearing journal depending from the bit body, and a single roller cone rotatably attached to the journal. The roller cone has a plurality of inserts disposed thereon. In another aspect, the inserts are arranged such that at most about 20 percent of the inserts are crossed substantially at centerlines thereof by any single plane which contains the axis of the cone axis 10 and which crosses at least two of the inserts.

54 Claims, 2 Drawing Sheets

SINGLE-CONE ROCK BIT HAVING CUTTING STRUCTURE ADAPTED TO IMPROVE HOLE CLEANING, AND TO REDUCE TRACKING AND BIT BALLING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF INVENTION

1. Field of the Invention

The invention relates generally to the field of roller cone ("rock") bits used to drill wellbores through earth formations. More specifically, the invention is related to structures for the roller cone for single cone rock bits.

2. Background Art

Roller cone bits are one type of drill bit used to drill wellbores through earth formations. Roller cone bits include a bit body adapted to be coupled to a drilling tool assembly or "drill string" which rotates the bit as it is pressed axially into the formations being drilled. The bit body includes one or more legs, each having thereon a bearing journal. The most commonly used types of roller cone drill bits include three such legs and bearing journals. A roller cone is rotatably mounted to the bearing journal. During drilling, the roller cones rotate about the respective journals while the bit is rotated. The roller cones include a number of cutting elements, which may be press fit inserts made from tungsten carbide and other materials, or may be milled steel teeth. The cutting elements engage the formation in a combination of crushing, gouging and scraping action which removes small segments of the formation being drilled.

One particular type of roller cone drill bit includes only one leg, bearing journal and roller cone rotatably attached thereto. The drilled hole and the longitudinal axis of this type of bit are generally concentric. This type of drill bit has generally been preferred for drilling applications when the diameter of the hole being drilled is small (less than about 4 to 6 inches [10 to 15 cm]) because the bearing structure can be larger relative to the diameter of the drilled hole when the bit only has one concentric roller cone. This is in contrast to the typical three-cone rock bit, in which each journal must be smaller relative to the drilled hole diameter. An example of a single cone rock bit is shown in U.S. Pat. No. 6,119,797 issued to Hong et al.

An important performance aspect of any drill bit is the ability of drilling fluid ("mud") pumped through orifices in the bit body to clean the bit, to cool and lubricate the cutting structures on the bit and to lift cuttings out of the wellbore ("hole cleaning"). Hole cleaning is a particular problem for single cone bits because the cone occupies substantially the entire cross-section of the drilled hole, thus not providing ample space for cuttings evacuation past the cone.

Another aspect of bit performance is the ability of the bit to avoid "balling", a situation in which mud solids and formation cuttings become lodged between the individual cutting elements on the roller cone. Balling reduces the ability of the cuffing elements to penetrate formation, thereby reducing drilling performance.

Another performance aspect of a roller cone drill bit is its ability to avoid "tracking", a situation in which cutting elements traverse the same subset of the cross-section of the drilled hole, leaving other areas of the cross-section undrilled. Tracking reduces drilling performance because the hole bottom is not evenly drilled. Avoiding tracking in single cone rock bits is particularly difficult because of the very complex motion of the individual cutting elements on the roller cone as the bit drills earth formations.

Accordingly, it is desirable to have a single cone rock bit which has increased hole cleaning capacity, reduced tendency toward balling, and reduced tendency toward tracking.

SUMMARY OF INVENTION

One aspect of the invention is a roller cone drill bit, including a bit body adapted to be coupled to a drill string, a bearing journal depending from the bit body and a single roller cone rotatably attached to the bearing journal. The roller cone has a plurality of inserts disposed on it. The journal defines a rotation angle with respect to an axis of rotation of the bit such that the roller cone includes an intermittent contact zone and a continuous contact zone thereon. At least one of the inserts disposed in the continuous contact zone is made from a super hard material.

Another aspect of the invention is a roller cone drill bit, including a bit body adapted to be coupled to a drill string, a bearing journal depending from the bit body and a single roller cone rotatably attached to the bearing journal. The roller cone has a plurality of inserts disposed on it. The inserts have an extension length of at least 0.6 inches.

Another aspect of the invention is a roller cone drill bit, including a bit body adapted to be coupled to a drill string, a bearing journal depending from the bit body, and a single roller cone rotatably attached to the bearing journal. The roller cone has a plurality of inserts disposed thereon. The inserts are arranged in a plurality of substantially helical columns. The columns are arranged so that a plane containing the axis of the cone intersects at least one and at most two of the columns on one side of the cone surface.

Other aspects and advantages of the invention will be apparent from the following description and the appended claims.

DETAILED DESCRIPTION

Figure 1:
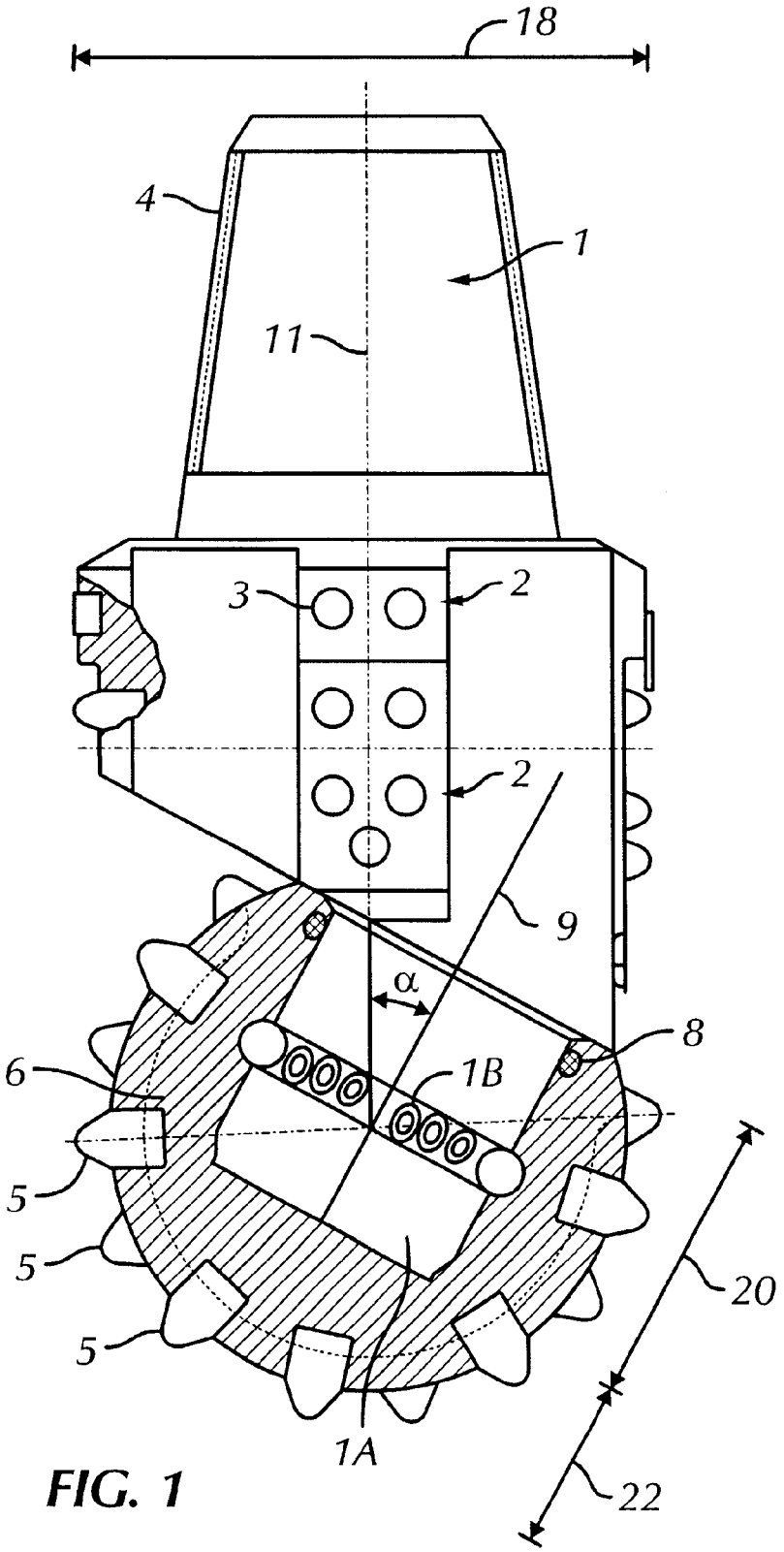
FIG. 1 shows an example structure for a single cone rock bit.

A general structure for a single cone rock bit which can be made according to various embodiments of the invention is shown in cut away view in FIG. 1. The bit includes a bit body 1 made of steel or other high strength material. The bit body 1 includes a coupling 4 at one end thereof that is adapted to join the bit body 1 to a drill string (not shown) for rotating the bit during drilling. The bit body 1 may include gage protection pads 2 at circumferentially spaced apart positions about the bit body 1. The gage protection pads 2 may include gage protection inserts 3 in some embodiments. The gage protection pads 2, if used, extend to a drill diameter 18 of the bit. Other embodiments of a bit according to the invention may not have gage pads.

The other end of the bit body 1 includes a bearing journal 1A to which a single, generally hemispherically shaped roller cone 6 is rotatably mounted. In some embodiments, the cone 6 may be locked onto the journal 1A by retaining or locking balls 1B disposed in corresponding grooves or races on the outer surface of the journal 1A and on the interior surface of the cone 6. Locking balls are only one example of a mechanism to retain the cone 6 on the journal 1A. The means by which the cone 6 is rotatably locked onto the journal 1A is not meant to limit the scope of the invention.

The cone 6 is formed from steel or other high strength material, and may in some embodiments be covered about its exterior surface with hardfacing or similar coating intended to reduce abrasive wear of the cone 6. In some embodiments, the cone 6 will include a seal 8 disposed to exclude fluid and debris from entering the space between the inside of the cone 6 and the journal 1A. Such seals are well known in the art. The journal 1A and cone 6 are arranged so that the cone 6 is roughly concentric with the longitudinal axis 11 of the bit body 1. The journal 1A depends from the bit body 1 such that it defines an angle $\alpha$ between the rotational axis 9 of the journal 1A and the rotational axis of the bit 11. The size of this angle $\alpha$ will depend on factors such as the nature of the earth formations being drilled by the bit.

The cone 6 includes a plurality of cutting elements thereon at selected positions, which in various embodiments of the invention are inserts 5 generally interference fit into corresponding sockets (not shown separately) in the outer surface of the cone 6. The inserts 5 may be made from tungsten carbide, other metal carbide, or other hard materials known in the art for making drill bit inserts. The inserts 5 may also be made from polycrystalline diamond, boron nitride or other super hard material known in the art, or combinations of hard and super hard materials known in the art.

Figure 2:
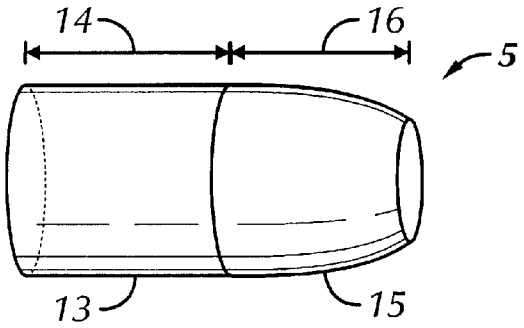
FIG. 2 shows an insert before insertion into a roller cone.

FIG. 2 shows one of the inserts 5 apart from the cone (6 in FIG. 1) to explain one aspect of the invention. The insert 5 includes a bottom portion 13 having a length shown by numeral 14. The bottom portion 13 is inserted into the corresponding socket (not shown) in the cone. A part of the insert 5 that extends outward from the surface of the cone (6 in FIG. 1) and contacts the formation being drilled is referred to as the extension portion, and is shown at 15. In one aspect of the invention, an axial length 16 of the extension portion 15 (extension length) is selected to improve hole cleaning and to reduce bit balling. This amount of extension allows sufficient space between the surface of the cone 6 and the hole bottom (not shown) to allow cuttings to pass by the cone 6 and up the bore hole annulus. Increasing this space also reduces the high fluid velocity around the cone which can cause detrimental cone shell erosion and seal failures. Increasing this space also reduces the potential of cuttings from being "packed" unto the cone 6 which will reduce the efficiency of cuttings removal. In a bit according to this aspect of the invention, at least one of the inserts 5, and more preferably substantially all the inserts, have an extension length 16 of at least 0.6 inches.

In some embodiments of a bit according to this aspect of the invention, the extension length of the at least one and preferably substantially all the inserts 5 is at least 0.7 inches when the drill diameter (18 in FIG. 1) of the bit is between about 5.875 and 8.999 inches.

In some embodiments of a bit according to this aspect of the invention, the extension length of the at least one and preferably substantially all the inserts 5 is at least 0.8 inches when the drill diameter (18 in FIG. 1) of the bit is between 9.000 and 17.250 inches.

In some embodiments of a bit according to this aspect of the invention, the extension length of the at least one and preferably substantially all the inserts 5 is at least 0.7 inches when the drill diameter (18 in FIG. 1) of the bit is between 9.000 and 17.250 inches.

In some embodiments of a bit according to this aspect of the invention, the extension length of the at least one and preferably substantially all the inserts 5 is at least 0.6 inches when the drill diameter (18 in FIG. 1) of the bit is between about 5.875 and 8.750 inches.

Figure 3:
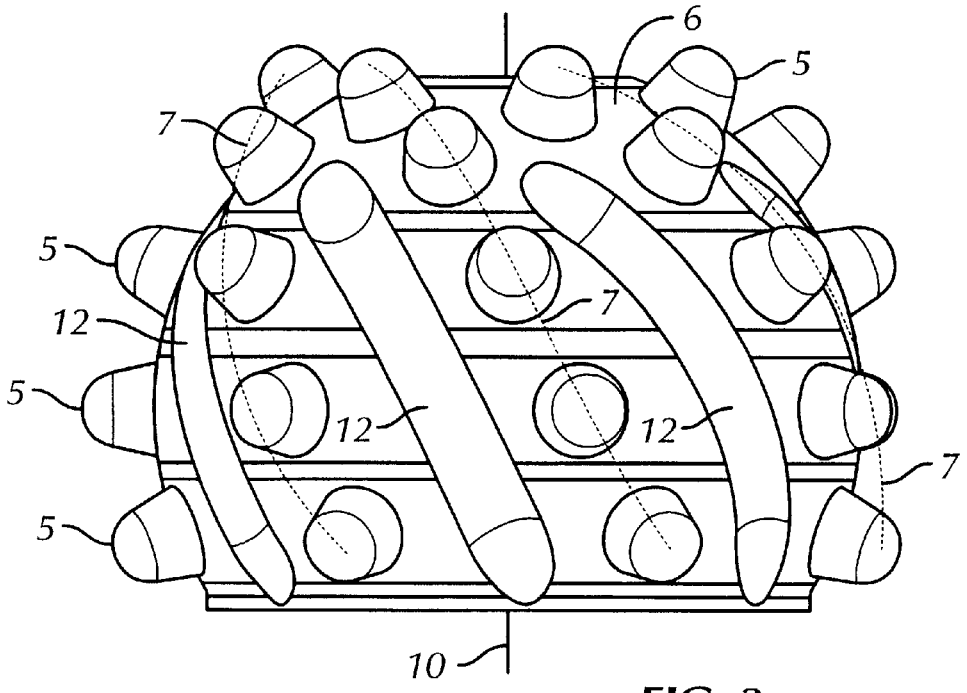
FIG. 3 shows one embodiment of a roller cone for a single cone rock bit.

One embodiment of the cone 6 is shown in more detail in FIG. 3 to illustrate other aspects of a single cone rock bit according to the invention. In this embodiment, the inserts 5 are positioned about the exterior of the cone 6 along a plurality of what can be described as helically shaped columns, the profiles of which are outlined by dotted lines 7. Each such column passes substantially through the intersection of the insert cutting tip and the centerline of each of the inserts 5 located thereon. In one aspect, the columns 7 are arranged so that a plane (not shown) containing the axis 10 of the cone 6 will intersect at least one, and at most two of the columns 7 on one side of the cone surface with the columns not being parallel to this plane. "Containing" as defined with respect to the axis 10 and the plane (not shown) means that the axis lies in the plane, rather than intersecting at a single point. In one embodiment, there are seven of the columns 7. It is believed that arranging the inserts according to this aspect of the invention will result in less tracking of the inserts are a wellbore is drilled.

In one embodiment, the columns 7 are disposed on portions of the cone surface which are elevated with respect to the portions, shown at 12, disposed between the columns 7. The portions shown at 12 may be in the form of grooves or channels cut below the general hemispherical exterior surface of the cone 6. Alternatively, the portions 12 between the columns 7 may be formed by having the columns 7 disposed on raised structures similar to blades or ribs. In either case, the portions 12 serve to improve hole cleaning and to reduce bit balling.

In another aspect, the inserts 5 are arranged about the surface of the cone 6 in a helical column configuration 7 such that that the adjacent inserts to any specified insert within the same column are the only inserts within that column that overlap the specified insert. Overlap is defined such that a plane containing the cone axis will pass through a portion of the specified insert's extension portion and at the same time pass through one and only one adjacent insert's extension. Such arrangements of the inserts 5 on the cone 6, including the previously described helical arrangement, can substantially reduce tracking.

Referring once again to FIG. 1, as previously explained, the journal 1A depends from the bit body 1 such that it defines an angle $\alpha$ between the rotational axis 9 of the journal 1A and the rotational axis of the bit 11. Because the bit body 11 and the cone 6 rotate about different axes, the motion of the inserts 5 during drilling can be roughly defined as falling within an intermittent contact zone 20, in which the inserts 5 located therein intermittently contact the outer diameter (wall) of the wellbore, and a continuous contact zone 22, in which the inserts 5 located therein are in substantially continuous contact with the earth formations, and depending on their position on the cone, may or may not contact the outer diameter (wall) of the wellbore during drilling. The inserts 5 in the intermittent contact zone 20 generally define the drill diameter 18 of the bit. Inserts in the continuous contact zone 22 generally wear more than inserts in the intermittent contact zone 20. In another aspect of the invention, at least one of, and preferably substantially all of the inserts 5 in the continuous contact zone 22 may be made from super hard material such as diamond or boron nitride. Having such inserts in the continuous contact zone 22 may improve the overall life of the bit by equalizing wear of all the inserts 5.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A roller cone drill bit, comprising:

a bit body adapted to be coupled to a drill string;

a bearing journal depending from the bit body; and a single roller cone rotatably attached to the bearing journal, the roller cone having a plurality of inserts disposed at selected positions thereon, the journal defining a rotation angle with respect to an axis of rotation of the bit such that the roller cone includes an intermittent contact zone and a continuous contact zone thereon, at least one of the inserts disposed in the continuous contact zone made from a super hard material, wherein the inserts are arranged in a plurality of substantially helical columns.

2. The bit as defined in claim 1 wherein the super hard material comprises one of diamond and boron nitride.

3. The bit as defined in claim 1 wherein the inserts have an extension length of at least 0.6 inches.

4. The bit as defined in claim 3 wherein a drill diameter of the bit is between about 5.875 and 8.999 inches.

5. The bit as defined in claim 4 wherein the extension length is at least 0.7 inches.

6. The bit as defined in claim 1 wherein an extension length of at least one of the plurality of inserts is at least 0.7 inches.

7. The bit as defined in claim 6 wherein a drill diameter of the bit is between about 9.000 and 17.250 inches.

8. The bit as defined in claim 1 wherein the inserts are arranged in columns such that any one of the inserts in a particular column is overlapped only by an adjacent one of the inserts in the particular columns.

9. The bit as defined in claim 1, the columns arranged so that a plane containing the axis of the cone intersects at least one and at most two of the columns on one side of the cone surface.

10. The bit as defined in claim 9 wherein the inserts are arranged in seven of the columns.

11. The bit as defined in claim 9 further comprising channels in a surface of the cone between the columns.

12. The bit as defined in claim 11 wherein the channels are formed by depression of the surface of the cone.

13. The bit as defined in claim 11 wherein the channels are formed by disposing the columns on raised portions of the surface of the cone.

14. A roller cone drill bit, comprising:

a bit body adapted to be coupled to a drill string;

a bearing journal depending from the bit body; and a single roller cone rotatably attached to the bearing journal, the roller cone having a plurality of inserts disposed at selected positions thereon, the inserts having an extension length of at least 0.6 inches, the inserts being arranged in a plurality of substantially helical columns.

15. The bit as defined in claim 14 wherein a drill diameter of the bit is between about 5.875 and 8.999 inches.

16. The bit as defined in claim 15 wherein the extension length is at least 0.7 inches.

17. The bit as defined in claim 14 wherein the extension length is at least 0.7 inches.

18. The bit as defined in claim 17 wherein a drill diameter of the bit is between about 9.000 and 17.250 inches.

19. The bit as defined in claim 18 wherein the extension length is at least 0.8 inches.

20. The bit as defined in claim 14 wherein the inserts are arranged such that one of the inserts in a particular column is overlapped only by an adjacent one of the inserts in the particular column.

21. The bit as defined in claim 14, the columns arranged so that a plane containing the axis of the cone intersects at least one and at most two of the columns on one side of the cone surface.

22. The bit as defined in claim 21 wherein the inserts are arranged in seven of the columns.

23. The bit as defined in claim 21 further comprising channels in a surface of the cone between the columns.

24. The bit as defined in claim 23 wherein the channels are formed by depression of the surface of the cone.

25. The bit as defined in claim 23 wherein the channels are formed by disposing the columns on raised portions of the surface of the cone.

26. The bit as defined in claim 14 wherein the journal defines a rotation angle with respect to an axis of rotation of the bit such that the roller cone includes an intermittent contact zone and a continuous contact zone thereon, at least one of the inserts disposed in the continuous contact zone made from a super hard material.

27. The bit as defined in claim 26 wherein the super hard material comprises one of diamond and boron nitride.

28. A roller cone drill bit, comprising:

a bit body adapted to be coupled to a drill string;

a bearing journal depending from the bit body;

a single roller cone rotatably attached to the bearing journal, the roller cone having a plurality of inserts disposed thereon, the inserts arranged in a plurality of substantially helical columns such that any one of the inserts in a particular column is overlapped only by an adjacent one of the inserts in the particular columns.

29. The bit as defined in claim 28 wherein the inserts have an extension length of at least 0.6 inches.

30. The bit as defined in claim 28 wherein a drill diameter of the bit is between about 5.875 and 8.999 inches.

31. The bit as defined in claim 30 wherein an extension length of at least one the plurality of inserts is at least 0.7 inches.

32. The bit as defined in claim 28 wherein an extension length of at least one the plurality of inserts is at least 0.7 inches.

33. The bit as defined in claim 32 wherein a drill diameter of the bit is between about 9.000 and 17.250 inches.

34. The bit as defined in claim 28, the columns arranged so that a plane containing the axis of the cone intersects at least one and at most two of the columns on one side of the cone surface.

35. The bit as defined in claim 34 wherein the inserts are arranged in seven of the columns.

36. The bit as defined in claim 34 further comprising channels in a surface of the cone between the columns.

37. The bit as defined in claim 36 wherein the channels are formed by depression of the surface of the cone.

38. The bit as defined in claim 36 wherein the channels are formed by disposing the columns on raised portions of the surface of the cone.

39. The bit as defined in claim 28 wherein the journal defines a rotation angle with respect to an axis of rotation of the bit such that the roller cone includes an intermittent contact zone and a continuous contact zone thereon, at least one of the inserts disposed in the continuous contact zone made from a super hard material.

40. The bit as defined in claim 39 wherein the super hard material comprises one of diamond and boron nitride.

41. A roller cone drill bit, comprising:

a bit body adapted to be coupled to a drill string;

a bearing journal depending from the bit body; and a single roller cone rotatably attached to the bearing journal, the roller cone having a plurality of inserts disposed thereon, the inserts arranged in a plurality of substantially helical columns, the columns arranged so that a plane containing the axis of the cone intersects at least one and at most two of the columns on one side of the cone surface.

42. The bit as defined in claim 41 wherein the inserts are arranged in seven of the columns.

43. The bit as defined in claim 41 further comprising channels in a surface of the cone between the columns.

44. The bit as defined in claim 43 wherein the channels are formed by depression of the surface of the cone.

45. The bit as defined in claim 43 wherein the channels are formed by disposing the columns on raised portions of the surface of the cone.

46. The bit as defined in claim 41 wherein the journal defines a rotation angle with respect to an axis of rotation of the bit such that the roller cone includes an intermittent contact zone and a continuous contact zone thereon, at least one of the inserts disposed in the continuous contact zone made from a super hard material.

47. The bit as defined in claim 46 wherein the super hard material comprises one of diamond and boron nitride.

48. The bit as defined in claim 41 wherein the inserts have an extension length of at least 0.6 inches.

49. The bit as defined in claim 48 wherein a drill diameter of the bit is between about 5.875 and 8.250 inches.

50. The bit as defined in claim 49 wherein the extension length is at least 0.7 inches.

51. The bit as defined in claim 41 wherein an extension length of at least one the plurality of inserts is at least 0.7 inches.

52. The bit as defined in claim 51 wherein a drill diameter of the bit is between about 9.000 and 17.250 inches.

53. The bit as defined in claim 52 wherein the extension length is at least 0.8 inches.

54. The bit as defined in claim 41 wherein the inserts arranged in columns such that one of the inserts is overlapped only by an adjacent one of the inserts within one of the columns.

* * * * *

UNITED STATES PATENT AND TRADEMARK OFFICE

CERTIFICATE OF CORRECTION

PATENT NO. : 6,719,073 B2
DATED : April 13, 2004
INVENTOR(S) : Ying Xiang et al.

It is certified that error appears in the above-identified patent and that said Letters Patent is hereby corrected as shown below:

Column 5,
Line 45, it should read -- column -- instead of “columns”.

Column 6,
Line 42, it should read -- column -- instead of “columns”.

Signed and Sealed this

Thirteenth Day of July, 2004

JON W. DUDAS
*Acting Director of the United States Patent and Trademark Office*